US006655639B2

(12) United States Patent
Grappone

(10) Patent No.: US 6,655,639 B2
(45) Date of Patent: Dec. 2, 2003

(54) BROKEN RAIL DETECTOR FOR COMMUNICATIONS-BASED TRAIN CONTROL AND POSITIVE TRAIN CONTROL APPLICATIONS

(75) Inventor: Victor F. Grappone, Hicksville, NY (US)

(73) Assignee: Grappone Technologies Inc., Hicksville, NY (US)

( * ) Notice: Subject to any disclaimer, the term of this patent is extended or adjusted under 35 U.S.C. 154(b) by 0 days.

(21) Appl. No.: 10/077,162

(22) Filed: Feb. 15, 2002

(65) Prior Publication Data

US 2002/0113170 A1 Aug. 22, 2002

Related U.S. Application Data

(60) Provisional application No. 60/270,411, filed on Feb. 20, 2001, and provisional application No. 60/317,512, filed on Sep. 5, 2001.

(51) Int. Cl.[7] ..... B61L 23/04
(52) U.S. Cl. ..... 246/120
(58) Field of Search ..... 246/120, 121, 246/218, 219, 20, 28 R

(56) References Cited

U.S. PATENT DOCUMENTS

| | | | | |
|---|---|---|---|---|
| 4,886,226 A | * | 12/1989 | Frielinghaus | 246/121 |
| 5,680,054 A | * | 10/1997 | Gauthier | 324/713 |
| 5,743,495 A | * | 4/1998 | Welles et al. | 246/121 |
| 6,102,340 A | * | 8/2000 | Peek et al. | 246/121 |

* cited by examiner

*Primary Examiner*—S. Joseph Morano
*Assistant Examiner*—Robert J. McCarry, Jr.
(74) *Attorney, Agent, or Firm*—Abelman, Frayne & Schwab

(57) ABSTRACT

A method and apparatus detect completely broken rails in an unoccupied section of railroad track including two rails without insulated joints by subdividing the track section into current loops and applying commercial AC power near the physical center of the track section while causing, under the condition of the rails being intact, approximately equal currents to flow in each resulting half of the track section. Currents are sensed through induction of voltages in an electrically-isolated coil mounted directly to the rails. A rail break is detected from a subsequent decrease in the coil voltage resulting from a reduction of current due to the rail break in at least one half of the track section with respect to a reference value determined while the rails were intact and due to the break.

32 Claims, 9 Drawing Sheets

BROKEN RAIL DETECTOR FOR COMMUNICATIONS-BASED TRAIN CONTROL AND POSITIVE TRAIN CONTROL APPLICATIONS

This application claims the benefit of U.S. Provisional application Serial No. 60/270,411, and 60/317,512.

FIELD OF THE INVENTION

This invention relates to the fail-safe detection of dangerous rail conditions such as broken railroad tracks.

BACKGROUND OF THE INVENTION

The danger of broken rails has been obvious to the railroads almost since their inception. The resulting potential for trains to derail has been the subject of considerable efforts aimed at the detection of broken rails and the subsequent automatic warning or control of trains in response to the danger. The classical approach to this problem has been through the use of track circuits, even though the detection of broken rails is not their primary function. Track circuits were developed in the 1870's for the purpose of determining whether a given section of track was clear of trains.

Referring to FIG. 1, a track circuit consists of the two rails [1] of a section of track electrically isolated by insulated joints [2] that determine the boundaries of the track section in which trains are to be detected. A battery [3] and a "track" relay [4] are each connected to the respective rails. When no train is present, current produced by the battery [3] flows though rails [1] and the track relay [4], thereby energizing the track relay [4]. If a train is present, its wheels and axles [5] provide a low impedance path in parallel with the track relay [4], effectively "shunting" it and thereby de-energizing it. Contacts [6] of the track relay [4] that are closed when the track relay [4] is energized, i.e. "front" contracts, are used as an input to signal or train control systems to provide positive and fail-safe indication that the track section is clear of trains when such contacts [6] are closed.

The choices of arranging the track relay [4] such that it is energized when no train is present, as well as the use of front contacts [6] for the indication of the track section being clear, are both made to ensure fail-safety. If the battery [3] were to fail, or if a wire were to break, the track relay [4] would assume the de-energized position, which corresponds to the presence of a train. Signal and train control systems are almost universally designed to stop trains or to restrict their speed when the associated track relays are de-energized, and therefore respond to the presence of trains and to track circuit failures in an identical and fail-safe manner.

Shortly after the initial development of the track circuit, an important shortcoming was discovered. Referring to FIG. 1, if a rail were to break at point [7], the shunting effect of the train [5] would be isolated from the track relay [4], which would now fail to detect the train. This situation would give rise to a non-fail-safe state in which the track section would falsely be indicated as being clear.

In response to this possibility, a modification to the track circuit design was made. Referring to FIG. 2, as compared to FIG. 1, the track relay [4] has been relocated to the end of the track circuit opposite to that of the battery [3]. As a result, the unsafe situation referred to above could no longer exist because the rail break [7] would no longer prevent the shunt [5] of the train from de-energizing the track relay [4]. A secondary benefit of this revised configuration is that broken rail detection is provided because any break [7] in an unoccupied track circuit would occur between the battery [3] and the track relay [4], thereby de-energizing the track relay [4].

It can be seen, therefore, that broken rail detection is largely a by-product of the basic design of a track circuit. This is underscored by the fact that track circuits in some applications are arranged with insulated joints on one rail only. These "single rail" track circuits are simpler than the more common "double rail" track circuits described above, but they only detect breaks in one rail.

In practice, there are considerable challenges to be met in the proper design and operation of track circuits. Each track circuit must be adjusted such that sufficient energy reaches the track relay [4] so as to energize it, while simultaneously being such that the shunt [5] of a train, which may be a single wheel set, will de-energize the track relay [4]. In addition, continuously and widely varying track ballast impedance that also tends to shunt the track relay energy must be contended with. These phenomena make the adjustment of track circuits very critical, resulting in reduced reliability. In fact, track circuit failures represent a significant proportion of signal and train control system failures.

More recently, electronic track circuits were developed that do not require insulated joints for track section delineation. These operate on the principal of applying audio range electronic signals with different frequencies and/or modulating schemes on the track and detecting these signals with matching receivers. These track circuits are associated with relatively complex circuitry to generate and decode the electronic signals because many such signals may be present due to the absence of insulated rail joints.

An additional complication in the design of track circuits is the requirement for compatibility in electrified territory. In such applications, the rails are used not only as part of the track circuits, but for the return of train propulsion current to substations. This requirement is usually met through the use of "impedance bonds" at the ends of each track circuit. These provide a very low impedance to the traction return current while maintaining a nominal impedance in the approximate range of one to ten ohms across the rails so that track circuit operation may be maintained. The presence, however, of these otherwise undesired impedances across the rails results in even further criticality in track circuit adjustment. In electrified territory, track circuits generally utilize a special 100 Hz power source eliminate any possibility of interference between track circuits and traction power or adjacent commercial power lines.

Beyond train detection and broken rail detection, there is a third function of conventional track circuits that is employed in some systems. This is to apply coded cab signals to the tracks so as to be received by equipment onboard trains where it is decoded into discrete speed commands. Cab signals generally consist of a current that is modulated on and off at one of several distinct rates in the range of 50 to 420 cycles per minute, each rate corresponding to a defined allowable speed or signal "aspect" to be displayed in the train cab. This requires elaborate equipment to not only to generate and apply the codes, but to distinguish between them and the normal track circuit energy.

It can be readily seen that the prior art currently provides technically complex and costly solutions to the broken rail detection problem because of the need for track circuits to perform other functions.

The advent of new technologies in train control applications, such as Communications-Based Train Control (CBTC) or Positive Train Control (PTC), can provide for the detection of the precise location of trains without track circuits as well as the control of the speed of trains without cab signals. This removes the requirement for two of the three classical functions of track circuits. An opportunity therefore exists for the development of a broken rail detector that satisfies the remaining requirement. With this, the elimination of costly and maintenance intensive insulated rail joints and impedance bonds is made possible.

It is therefore desirable to provide a practical track-based broken rail detector that is simpler and more reliable than conventional track circuits, which is the subject of the present invention.

SUMMARY OF THE INVENTION

A fail-safe method and apparatus detect completely broken rails in railroad track without the use of insulated rail joints and utilizing only commercial AC power. This invention is intended for applications where conventional track circuits or cab signals are not required, in territory where the rails may be used for train propulsion power return. Applications include situations where no signal or train control system is used or where new technology train control systems including Communications-Based Train Control (CBTC) and Positive Train Control (PTC) that do not rely on conventional track circuits to determine train position are employed. The detection of broken rails is accomplished through the subdivision of railroad tracks into sections delineated by the rails themselves and by hard-wired connections (shunts) applied from rail to rail, forming current loops. Commercial AC power is applied at approximately the center of each loop, causing current to flow approximately equally in each half of the loop. The magnitude and direction of this current is sensed through the inductive coupling of a coil consisting of many turns of insulated wire that is attached to the rails, but electrically isolated from them, in a "figure eight" pattern. The voltage induced in the coil, which is proportional to the current in the current loop, is then monitored and compared to a reference value corresponding to the condition of the rails being intact. A subsequent break in the rail will be reflected by a decrease in loop current, and by a corresponding decrease in induced coil voltage below a certain threshold value.

A microprocessor-based controller is optionally utilized to detect and validate these parameters.

DETAILED DESCRIPTION OF THE PREFERRED EMBODIMENTS

Arrangement

Figure 1:
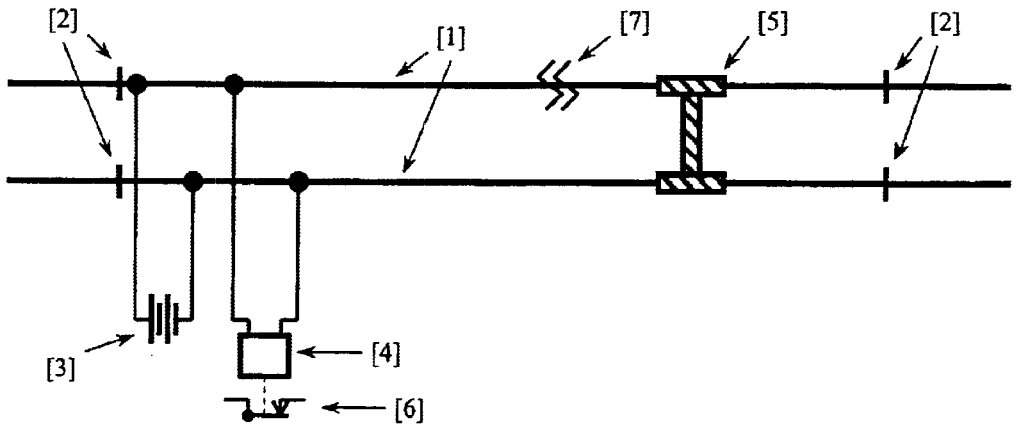
Figure 1 Prior Art
FIG. 1 depicts a conventional track circuit associated with the prior art.
Figure 2:
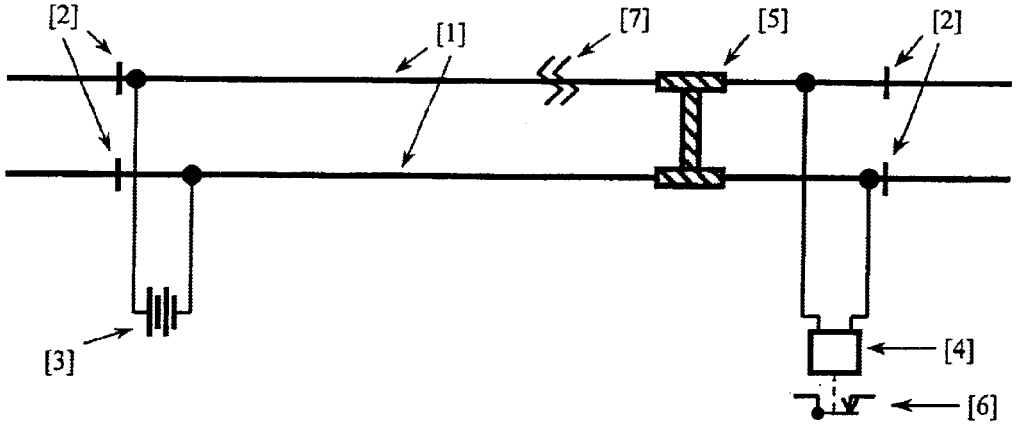
Figure 2 Prior Art
FIG. 2 depicts a conventional track circuit associated with the prior art as modified to provide broken rail detection.
Figure 3:
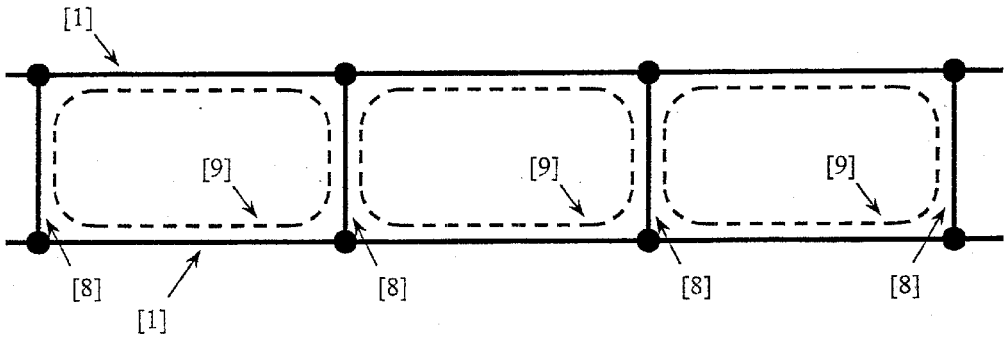
FIG. 3 depicts a typical railroad track divided into sections forming current loops within which broken rail detection is performed in accordance with the present invention.
Figure 4:
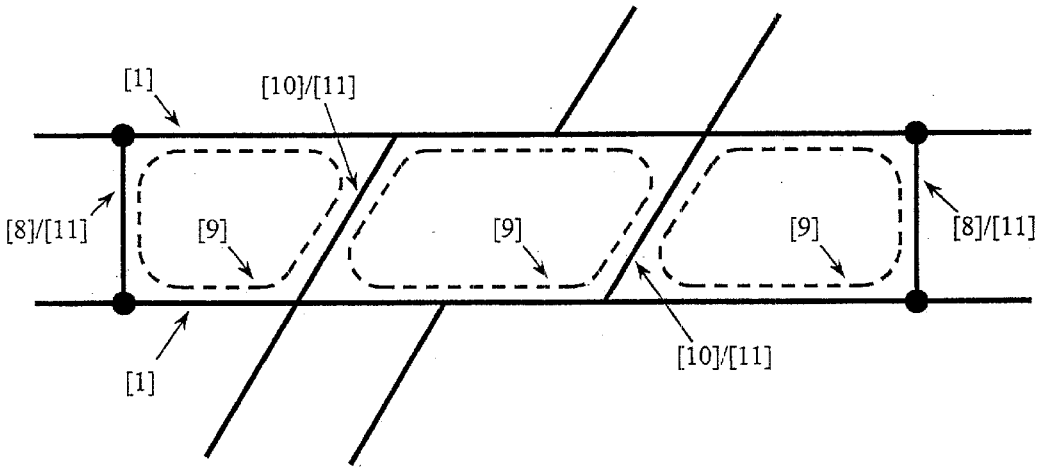
FIG. 4 depicts track sections and current loops associated with a more complex track arrangement associated with the presence of turnouts.

Referring to FIG. 3, the track is subdivided into sections that each form a closed, low impedance electrical circuit or "current loop" [9]. Each current loop [9] is defined by the two rails [1] and hard-wired connections between them, or "shunts" [8]. Alternatively, as shown in FIG. 4, loops may be completed by the presence of the closure rails of turnouts [10] at either end or both ends of a current loop [9] rather than by shunts [8]. This allows for the flexibility of detecting broken rails continuously throughout complex track arrangements as are commonly encountered. Referring to FIG. 4, because the shunts [8] and the closure rails [10] are functionally equivalent, they are collectively identified as "loop terminations" [11].

Figure 5:
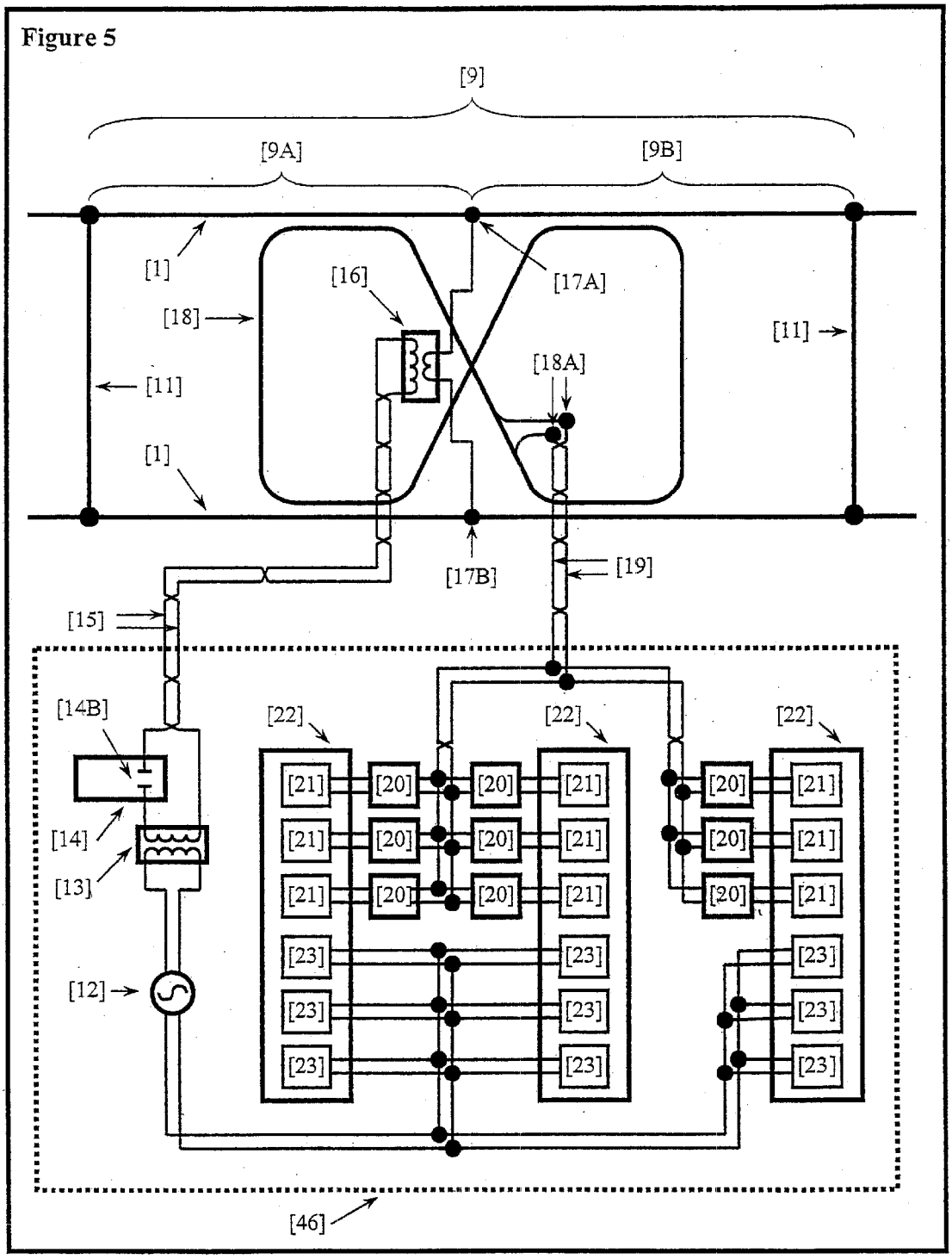
FIG. 5 depicts the general arrangement of apparatus associated with a single track section.

Referring now to FIG. 5, a commercial AC power source [12] is applied to an adjusting transformer [13] with several adjustable taps on its primary and secondary windings for the purpose of maintaining the current in the current loop [9], as well as the levels of other parameters described below, within acceptable values. The adjusting transformer [13] is connected through a contact [14B] of an enabling relay [14] to a step-down transformer [16] via track wires [15].

The step-down transformer [16] reduces the applied voltage to a range appropriate for the low impedance presented by the current loop [9] and to reduce the relative impedance of the track wires [15]. The secondary taps of the step-down transformer are connected at approximately the physical center of the axis of the current loop [9] parallel to train travel, corresponding to points [17A] and [17B], causing current to flow approximately equally in each respective half of the loop, [9A] and [9B]. The magnitude and direction of this current is sensed through inductive coupling of a coil [18] consisting of many turns of insulated wire that is attached to the rails, but is electrically isolated from them, in a "figure eight" pattern.

The following optional apparatus is also shown in FIG. 5. A pair of twisted wires [19] connects the terminals of the coil [18A] to each of at least one amplifier [20], each of which drive one analog input point ("detection point") [21] of each of at least one microprocessor-based controller [22]. Alternatively, if the specific circuit design parameters permit, the amplifiers [20] may be eliminated whereby the coil terminals [18A] are connected directly to the detection points [21]. Additionally and optionally, the commercial AC power source [12] is connected directly to each of at least one further analog input point ("source point") [23] of the microprocessor-based controllers [22].

It is to be noted that the commercial AC power source [12], the adjusting transformer [13], the enabling relay [14], the amplifiers [20], the detection points [21], the source points [23], and the microprocessor-based controllers [22] are all located in a wayside equipment enclosure [46] in order to ensure workers' safety and to facilitate routine maintenance.

Figure 6:
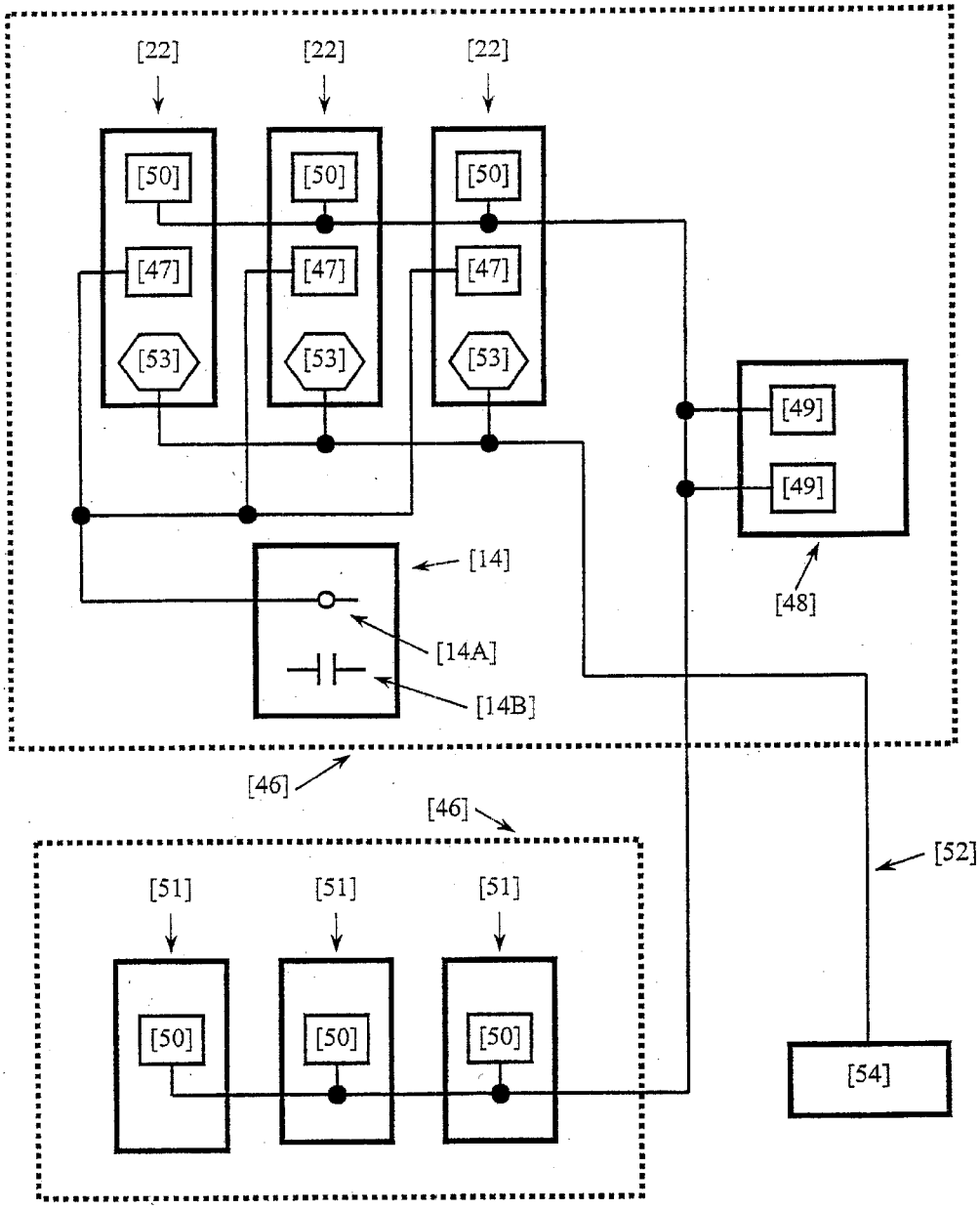
FIG. 6 depicts additional optional apparatus associated with the microprocessor-based controllers.

Referring now to FIG. 6, which shows further details of the arrangement, each of the microprocessor-based controllers [22] also includes a digital output point [47] which is connected to one of the control terminals [14A] of the enabling relay [14]. This output point provides means by which the microprocessor-based controllers [22] can control the application of power to the current loop [9] through a contact [14B] (also shown on FIG. 5) of the enabling relay [14].

The signal or train control system [54], if present in the particular application, is also shown in FIG. 6. This is connected via a data network [52] to data ports [53] in each of the microprocessor-based controllers [22].

Continuing to refer to FIG. 6, if required by the specific application as described below, a synchronizing clock [48] is connected via at least one digital output point [49] thereof to a digital input point [50] of each microprocessor-based controller [22]. The digital output points [49] of the synchronizing clock [48] are also so connected to the digital input points [50] of each of a separate and distinct set of microprocessor-based controllers [51] dedicated to the detection of broken rails in other current loops.

It is to be noted that the sets of microprocessor-based controllers [22] and [51] respectively, may be located in different wayside equipment enclosures [46] as shown, or in the same such enclosure.

Electrical Operation

Figure 7:
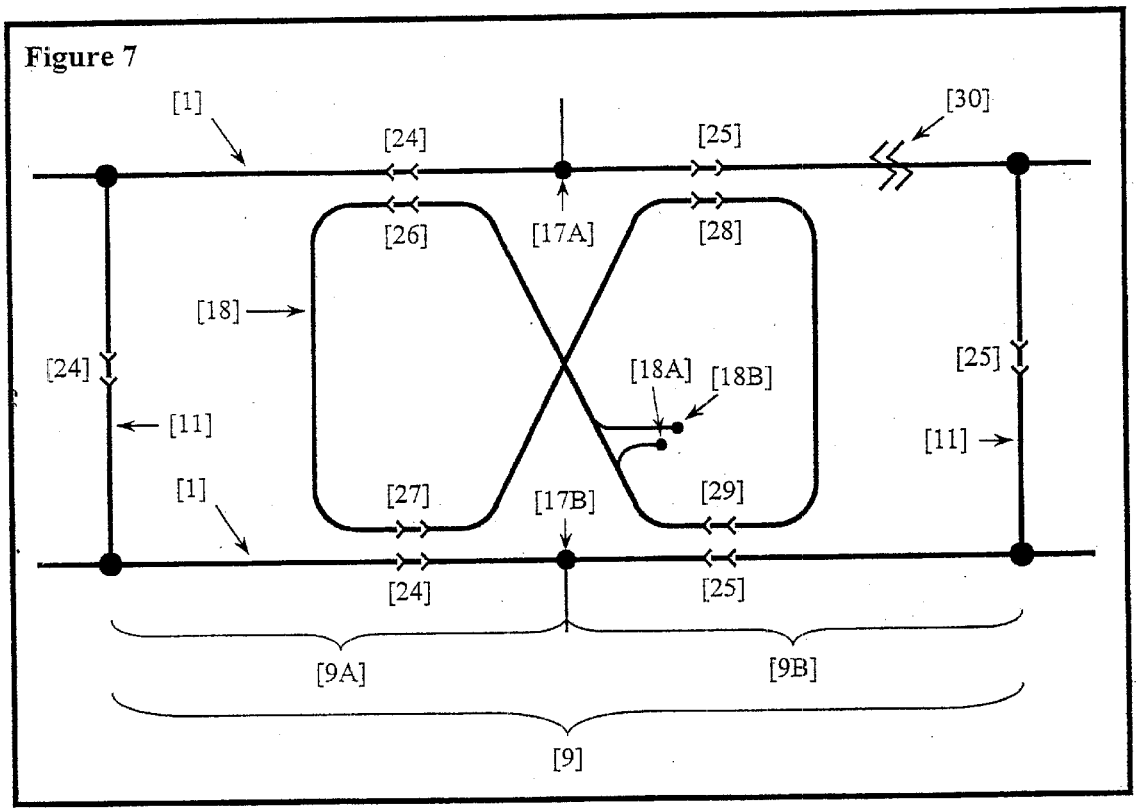
FIG. 7 depicts the manner in which voltages are induced from the current loop to the coil under normal operation and the location of a rail break to be detected.

Referring now to FIG. 7, reduced voltage power is applied as described above via track wires [15] and the step down transformer [16] at points [17A] and [17B]. The track wires [15] may be twisted and shielded for the purpose of eliminating the effect of any interfering inductive coupling. The resulting direction of loop current flow is represented by arrows [24] and [25] respectively in the halves of the current loop [9A] and [9B]).

Due to its "figure eight" configuration, the coil [18] is inductively coupled to the current loop [9] in each of four quadrants formed by the two rails [1] and the two halves of the current loop [9A] and [9B]. The direction of the voltage that results in each of these quadrants from this inductive coupling is indicated by arrows [26] and [27] for current loop half [9A], and by arrows [28] and [29] for current loop half [9B] respectively. Because the orientation of induced voltages [26], [27], [28] and [29] with respect to the coil [18] are the same, the voltage at the terminals of the coil [18A] or "coil voltage, (CV)" will be approximately the vector sum of induced voltages [26], [27], [28] and [29].

Continuing to refer to FIG. 7, the choice of applying the commercial AC power at approximately the center point [17A] and [17B] of the current loop [9] is made to ensure that the impedance of the rails [1], although very low, comprises a significant percentage of the total series impedance of each current loop half [9A] and [9B] as compared to the loop terminations [11]. In this manner, a rail break [30] in either current loop half, [9A] or [9B], will cause a significant and approximately equal reduction in the CV.

Figure 8:
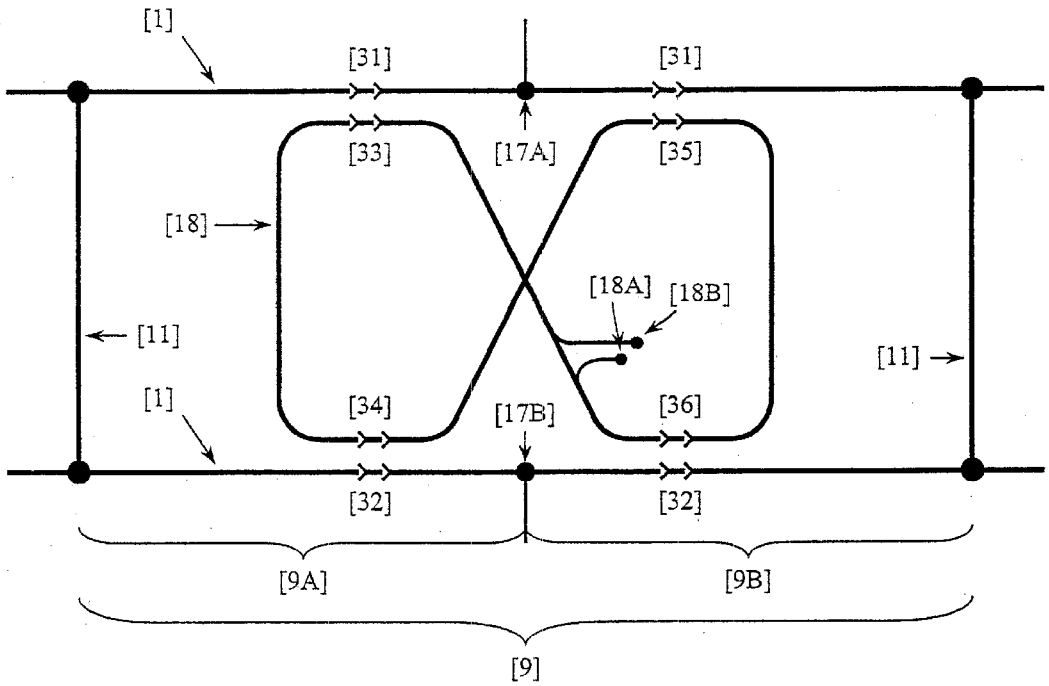
FIG. 8 depicts the manner in which interfering currents induce voltages into the current loop.

The elimination of the effects of ambient interfering currents that may be flowing in the in the rails [1], as may be present in electrified territory where the track is typically utilized for negative propulsion current return, is addressed as follows. Referring to FIG. 8, such interfering currents are represented by arrows [31] and [32], which may be unequal. If these currents are DC, no voltage will be induced in the coil [18] because inductive coupling cannot occur theoretically and in practice. If the interfering currents are AC, it can be seen that the effects of current [31] will induce voltages [33] and [35] respectively and equally in magnitude.

Because of the opposing orientation of induced voltages [33] and [35] with respect to the coil [18], induced voltages [33] and [35] will vectorially add to very near zero. A similar relationship exists between current [32] and induced voltages [34] and [36]. Therefore, no net interfering voltage will be induced in the coil [18] by interfering currents [31] and/or [32].

Microprocessor-Based Controller Operation

Although the above description provides the fundamental means of providing broken rail detection, the following further optional method and apparatus are disclosed for a more complete means of providing such detection and to provide fail-safety.

Referring now to FIG. 5, the CV is applied to each of at least one amplifier [20], via a pair of wires [19], which may be twisted and shielded for the purpose of eliminating the effect of any interfering inductive coupling. The amplifiers [20] are each connected to one detection point [21] of each of at least one microprocessor-based controller [22]. The amplifiers [20] serve the purpose of amplifying and/or rectifying the CV so as to match the input parameters of the detection points [21]. Alternatively, if the specific circuit design parameters permit, the amplifiers [20] may be eliminated whereby the CV is applied directly to the detection points [21].

Each microprocessor-based controller [22] is programmed such that it has two modes: "setup mode" and "operational mode".

Before it is put into operation, the system is calibrated in setup mode. The user first verifies that the rails of the current loop [9] being detected are actually intact and that it is clear of trains. The adjusting transformer [13] is then adjusted such that the resulting voltages at the detection points [21] are within their operational range, and above a specified minimum threshold value. Under these specific conditions the CV is referred to as the "normal coil voltage" (NCV). The NCV causes a voltage to be applied to each of the detection points [21] optionally via amplifiers [20]. The voltages, known as the "Normal Voltages", (NV1, NV2, etc.) of these voltages are validated by the microprocessor-based controller [22] wherein they must be within a predefined range referred to as the "normal value range" (NVR), which corresponds to the normal range expected under operating conditions.

In the case where one detection point [21] is provided for each microprocessor-based controller [22], if its NV is in within the NVR, it is validated as the "normal validated voltage" (NVV). In the case where two detection points [21] are provided for each microprocessor-based controller [22], their values are independently validated against the NVR. Additionally, they are compared to each other and accepted as valid only if they are equal or near equal based on a predefined "differential tolerance" (DT). The DT and NVR validations result in two such NVV's: "NVV1" and "NVV2". In cases where at least three detection points [21] are provided for each microprocessor-based controller [22], additional NVV's: "NVV3", "NVV4", etc.; are produced wherein the aforementioned DT and NVR validations are performed on each possible permutation of pairs of detection points [21].

If the DT and NVT comparisons are successful between any pair of detection points [21], then the NVV's for each of the members of the pair are validated. These NVV's serve as the baseline calibrated values against which further comparisons and validations performed by the microprocessor-based controllers [22] in operational mode as described below. Once the NVV's are calculated, they are stored. The system may then be placed in operational mode, wherein active broken rail detection is initiated.

In operational mode, the microprocessor-based controllers [22] continually monitor the voltages associated with each detection point [21] provided that the current loop [9] is clear of trains. Referring to FIG. 6, if a signal or train control system [54] is associated with the particular application, information as to the presence of trains may is provided through the data network [52] and data ports [53] of each microprocessor-based controller. Referring back to FIG. 5, the values of the detection point voltages are referred to as "operational values" ("OV's"). In the case where one detection point [21] is provided for each microprocessor-based controller [22], this value is referred to as "OV". In the case where two detection points [21] are provided for each microprocessor-based controller [22], their respective values are referred to as "OV1"and "OV2". In cases where at least three detection points [21] are provided for each microprocessor-based controller [22], additional such OV's ("OV3", "OV4", etc.) are defined and monitored. In cases where at least two detection points [21] are provided for each microprocessor-based controller [22], the successive values OV1, OV2, OV3, etc are subjected to DT validations similar to those described above for the NVV's. If these are successful, respective "operational validated values" "OVV1", "OVV2", "OVV3" etc are produced.

In the case where one detection point [21] is provided for each microprocessor-based controller [22], the OV is continually compared with the NVV. In cases where at least two detection points [21] are provided for each microprocessor-based controller [22], the respective OVV's (OVV1, OVV2, OVV3, etc) are continually compared with their corresponding NVV's (NVV1, NVV2, NVV3, etc. respectively).

Referring to FIG. 7, if the rails remain intact, the OV or OVV's will remain very near in value to their corresponding NVV's. If the rails [1] were to break, as at point [30], current [25] and induced voltages [28] and [29] will drop to near zero, thereby reducing the CV to approximately one half of the NCV. This will, in turn, cause the corresponding OV or OVV's to drop in value proportionately.

For each OV or OVV vs. NVV comparison, if the OV or OVV and the NVV remain equal within a predefined "comparison tolerance" (CT), each of the microprocessor-based controllers [22] will independently set a binary point designated as "RI(×)" to the "1"state, which corresponds to the condition of the rails being intact. The "×" suffix refers to the number of OV or OVV vs. NVV comparisons being made. In the case where one detection point [21] is provided for each microprocessor-based controller [22], each microprocessor-based controller [22] will determine that the rails are intact if its single RI bit is in the "1" state. In cases where at least two detection points [21] are provided for each microprocessor-based controller [22], each microprocessor-based controller [22] will determine that the rails are intact if any two of the respective RI points (RI1, RI2, RI3, etc.) are in the "1" state, and only if so will set its RI point to the "1" state.

The states of the individual RI(×) points, as well as that of the RI point for each microprocessor-based controller [22], are independently transmitted to the associated signal or train control system via data ports [53] and data network [54] shown in FIG. 6 if such signal or train control system is present in the particular application. If no such signal or train control system is present in the particular application, the data ports [53] and data network [54] may be utilized to transmit the RI point state information to any other system.

Fail Safety Enhancement

In order to enhance fail safety, it must be ensured that failures of any of the electronic components associated with the detection points [21], the amplifiers [20] (if required) and the source points [23] do not provide incorrect voltage information to the microprocessor-based controllers [22]. In this case, at least two detection points [21], two amplifiers [20] (if required) and two source points [23] are provided, and associated independent comparisons and validations as described above are performed by the microprocessor-based controllers [22].

In order to further enhance fail-safety, it must be ensured that processing failures in the microprocessor-based controllers [22] do not make a false determination that the rails are intact. In this case, two microprocessor-based controllers [22] are provided, each of which independently performs the comparisons and validations described above. The states of the resulting independent sets of RI(×) and RI points are then made available to external systems as described above, which can be arranged to determine that the rails are intact only if both microprocessor-based controllers [22] determine so independently.

Individual embodiments of the present invention may employ neither, either one, or both of the above mentioned options summarized as follows:

A: Providing two each of detection points [21], amplifiers [20] (if required) and source points [23] and two independent sets of comparisons and validations for each microprocessor-based controller.

B: Providing two microprocessor-based controllers.

Availability Enhancement

In order to enhance system availability while maintaining fail-safety, the failure of the detection points [21], the amplifiers [20] (if required), or the source points [23] must be accounted for. In this case, at least three detection points [21], at least three amplifiers [20] (if required) and at least three source points are provided to secure increased availability through redundancy. In this manner, failures may occur in any of the at least three sets each comprising one detection point [21], one amplifier [20] (if required), and one source point [23] wherein fail-safe operation is continued through the use of the two or more remaining and operational such sets.

In order to further enhance availability while maintaining fail-safety, the failure of the microprocessor-based controllers [22] must be addressed. In this case, at least three microprocessor-based controllers [22], each of which independently performs the comparisons and validations described above, are provided to secure increased availability through redundancy. In this manner, failures may occur in any of the at least three microprocessor-based controllers [22] wherein fail-safe operation is continued through the use of the two or more remaining microprocessor-based controllers [22].

Individual embodiments of the present invention may employ neither, either one, or both of the above mentioned options summarized as follows:

A: Providing at least three each of detection points [21]), amplifiers [20] (if required) and source points [23] and three independent sets of comparisons and validations for each microprocessor-based controller.

B: Providing at least three microprocessor-based controllers.

In order to further enhance availability, failures of the synchronizing clock [48] must be addressed. In this case, at least two digital output points [49] are provided to secure increased system availability through redundancy.

Special Cases

Figure 9:
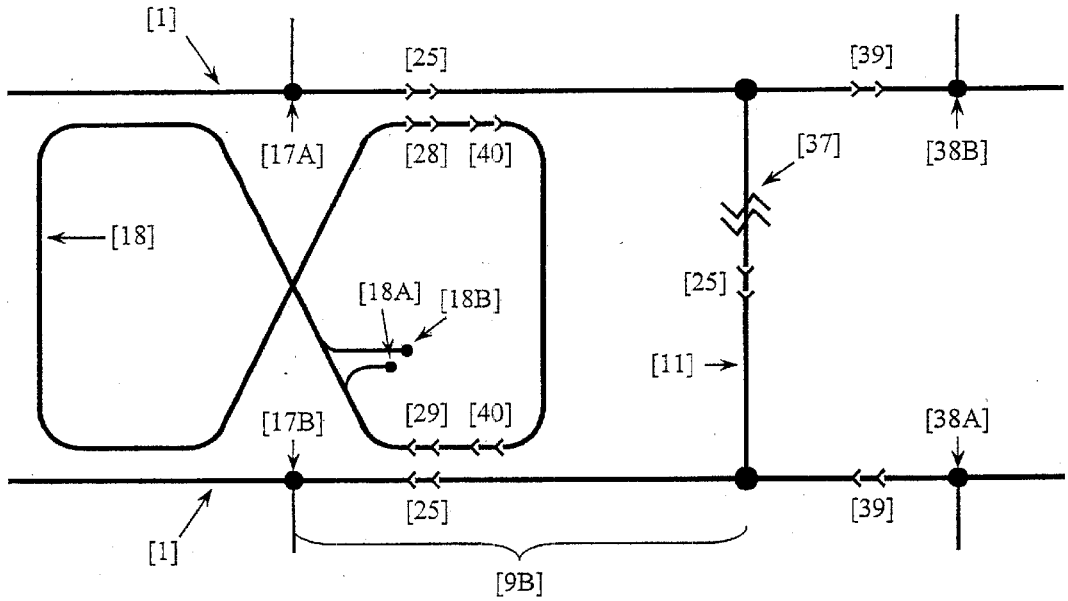
FIG. 9 depicts a special case in which a rail break has occurred in a rail that is common to two adjacent current loops.

A special case is illustrated in FIG. 9. Because the loop termination [11] may be a closure rail of a turnout, and because such a rail may break, as at point [37], it can be seen that the commercial AC power of the adjacent current loop applied at points [38A] and [38B] will cause interfering current [39] to flow, vectorially adding to the desired current [25]. This, in turn, will cause induced voltage [40] interfering with desired induced voltages [28] and [29]. In this case, each microprocessor-based controller [22] defines a unique time window that is selected from a cyclically recurring set of such time windows for each adjacent current loop during which, and only during which, its associated enabling relay contact [14B] (of FIG. 5) is closed. This is accomplished through a digital output point [47], which controls the enabling relay [14] via one of its control terminals [14B]. The above mentioned OV or OVV vs. NVV comparisons for a given current loop are only performed during its assigned time window, thereby eliminating such interference.

Referring now to FIG. 6, because the situation may arise where the above mentioned adjacent current loops are controlled by different sets of microprocessor-based controllers [22] and [51] respectively, in such cases a synchronizing subsystem including the synchronizing clock [48], its associated digital output points [49], the shown digital input points [50] of the microprocessor-based controllers, and the associated interconnections are provided for the purpose of synchronizing the unique time windows. If any failure were to occur in this synchronizing subsystem, the microprocessor-based controllers [22] and [51] are programmed to set their associated RI points to the "0" state, to enhance fail safety.

Figure 10:
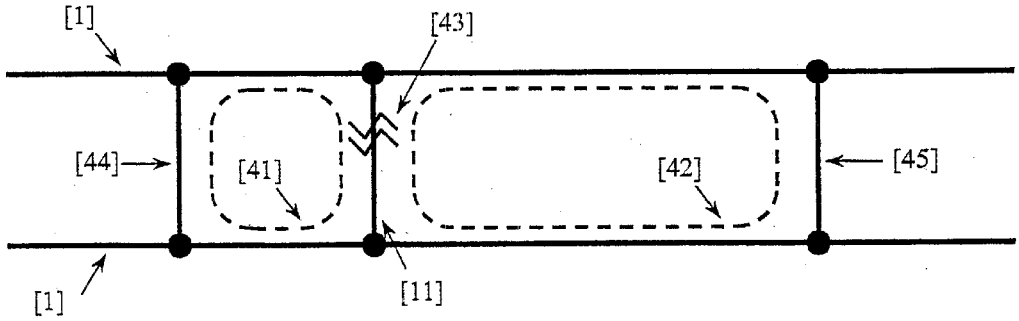
FIG. 10 depicts a further special case in which a rail break has occurred in a rail that is common to two adjacent current loops that differ materially in length.

A further special case wherein a rail break occurs in the loop termination [11] between two adjacent track sections that differ significantly in length is shown in FIG. 10. Such a break is shown between current loops [41] and [42] at point [43]. Because the impedance of current loop [42] is significantly higher than that of loop [41], the corresponding reduction in the current due to the break [43] in current loop [42], which is now flowing through loop termination [44], will be relatively small, and therefore potentially not sufficient to be detected by the OV or OVV vs. NVV comparisons for current loop [42]. However, because the rail break [43] is also common to current loop [41], it will conversely result in a significantly greater reduction of current in current loop [41], which is now flowing through loop termination [45], as compared with the reduction of current in current loop [42], such that the OV or OVV vs. NVV comparisons for current loop [41] will detect the rail break [43].

Compensation For Source Voltage Variations

In order to compensate for voltage variations in the commercial AC power source [12], as may be expected in practice, each of the microprocessor-based controllers [22] continually monitors the commercial AC power source [12] voltage via at least one source point [23] and adjusts the NVV's described above proportionately. The number of such source points [23] provided will be equal to the number of detection points [21] provided. In the case where one detection point [21] and one source point [23] is provided for each microprocessor-based controller [22], the source point [23] adjusts NVV. In cases where two or more detection points [21] and two or more source points [23] are provided for each microprocessor-based controller [22], the first source point [23] adjusts NVV1, the second adjusts NVV2, and so on. This source voltage variation is performed in Operational Mode.

Compensation For ballast Impedance Variations

Figure 11:
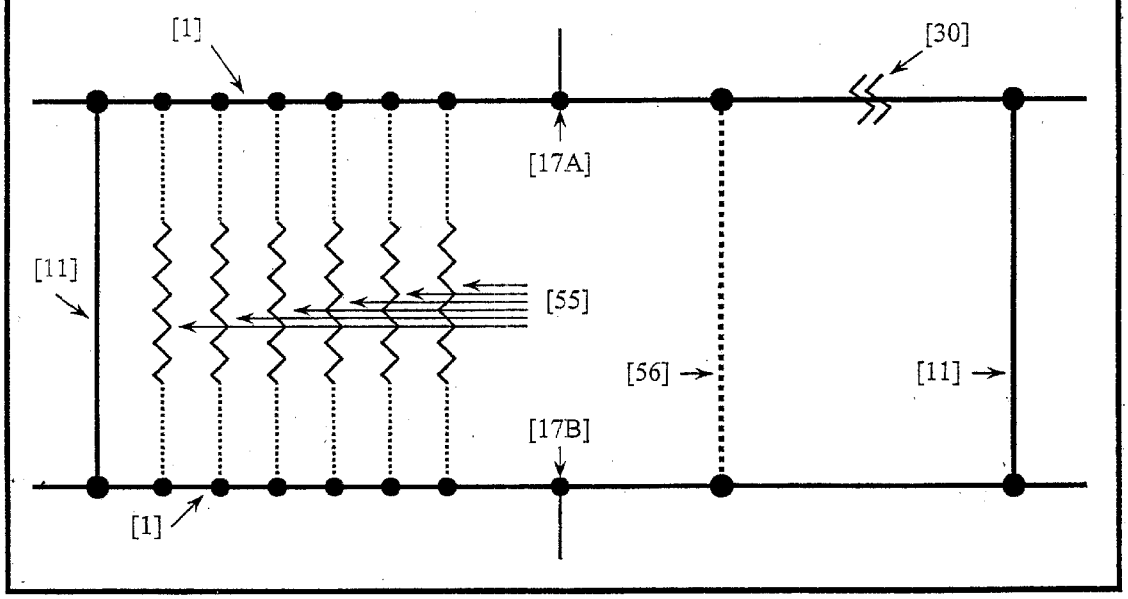
FIG. 11 depicts the effect of impedances between the rails due to track ballast and of undesired short circuits between the rails caused by metallic debris.

In practice, ambient conditions arise which could limit the effectiveness of the present invention. One of these is the presence of ballast impedance between the rails. FIG. 11 illustrates the presence of ballast impedance [55] distributed evenly along the track. This is due to the conductivity of the ballast material and contaminants such as water and other related factors. While the present invention is capable of proper operation under the conditions of constant ballast impedance, in practice this impedance regularly changes over time due to rainfall, temperature changes, humidity changes and the like.

The present invention includes a method of compensation for ballast impedance variation that operates under the assumption that the rate of change in the impedance of the current loops of the previous invention due to variations in ballast conditions will be much lower than the rate of change caused by a rail in the process of breaking. This method allows for Normal Validated Voltages (NVV's), rather than being held at constant value in operational mode as described above, to be dynamically adjusted due ballast impedance changes under the restriction that the rate of change of the NVV's does not exceed a predetermined value, such value being determined by the maximum rate at which the NVV's could change due to varying ballast conditions. If the maximum rate of change is exceeded, the values of the NVV's are not permitted to change, thereby allowing the comparisons of the NVV's vs. their corresponding Operational Validated Voltages (OVV's) to proceed as described above.

Figure 12:
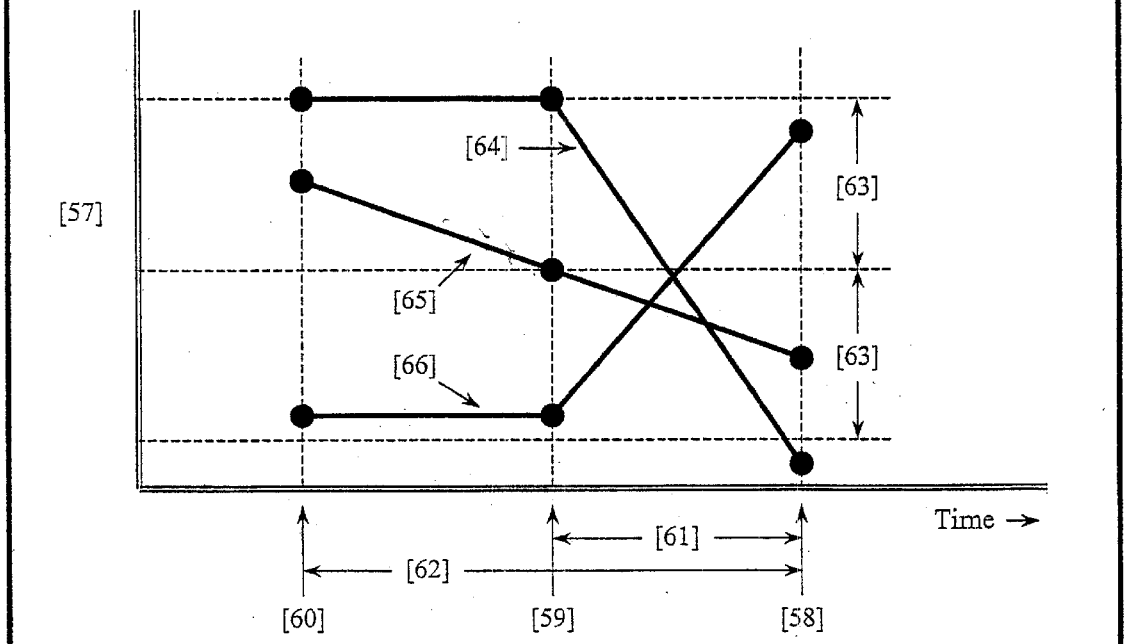
FIG. 12 depicts example sequences of voltage readings made at predefined time intervals for the purpose of illustrating the disclosed method of compensation for variations in ballast impedance.

Referring to FIGS. 5 and 12, the microprocessor-based controller(s) [22] defines a continuously running series of time intervals called the "Ballast Compensation Interval" (BCI) during each of which, each of the OVVs [57] is sampled and stored. Three such voltages are stored for each OVV: the "ballast present voltage, (PV)" at time [58]; and the ballast voltages of the first and second previous intervals, "BP1V" and "BP2V" respectively at times [59] and [60] respectively.

During each BCI, the BPV is subtracted from BP1V and from BP2V, yielding two differential values, the "ballast 1st differential" (B1D) and the "ballast 2nd differential" (B2D) respectively. B1D equals the increase in OVV over the previous interval [61]. B2D equals the increase in the OVV over the previous two intervals [62].

In order to determine the maximum allowable rate of chance of ballast impedance, a "ballast compensation interval tolerance" (BCIT) [63] is defined as a user programmable input to the microprocessor-based controller [22]. During each BCI, B1D is compared to BCIT [63]. If B1D exceeds BCIT [63], the maximum allowable rate of change of ballast impedance has been exceeded as shown in the example sequence [64] of OVV [57] readings. Example sequence [65] illustrates a case where the maximum allowable rate has not been exceeded.

Similarly, B2D is compared to BCIT [63] multiplied by two, because the B2D interval [62] is twice as long as the B1D interval [61]. If B2D exceeds BCIT [63] multiplied by two, again the maximum allowable rate of change of ballast impedance has been exceeded.

In order to filter out erroneous voltage readings, which would potentially cause false results in either B1D or B2D, the microprocessor-based controller [22] suspends the above mentioned adjustment of the NVV's only if both the B1D and B2D comparisons indicate that the maximum allowable rate of change of ballast impedance has been exceeded. If both the B1D and B2D comparisons indicate that the maximum allowable rate of change of ballast impedance has been exceeded, the microprocessor-based controller [22] interprets this as corresponding to a broken rail. Because the effect of a broken rail will only be detected during one pair of B1D and B2D comparisons, with successive comparisons indicating normal conditions, the adjustment of the NVV's is suspended until a reset point is manually set by a person who has verified the intact state of the rails.

As a further refinement of this method, it is to be noted that if the B1D or B2D differentials correspond to an increasing voltage, this must be caused by a decreasing loop impedance. This condition is shown in sequence [66]. Because a broken rail [30] will increase the loop impedance, it can be safely assumed that the previously mentioned maximum rate of change of ballast impedance may be exceeded while continuing to allow adjustments to the NVV's, provided that the corresponding OVV's [57] are increasing. For this reason, the microprocessor-based controller [22] senses the whether the OVV's [57] are increasing and, if so, continues to allow NVV adjustment regardless of the B1D or B2D values.

Detection of Foreign Metallic Objects Across the Rails

In practice, foreign metallic objects may fall on the rails that could interfere with the detection of broken rails. This is illustrated in FIG. 11 wherein such an object creates a short circuit [56]. It can be readily seen that an increased impedance of rail break [30] at a point further away from the point at which rail current is applied [17A]/[17B], would not cause an increase in the impedance between points [17A] and [17B], thereby precluding broken rail detection in that area.

In order to address this situation, a detection method similar to the above mentioned method of compensation for ballast impedance variation is employed. In contrast, this method does not attempt to compensate for short circuits caused by foreign metallic objects, but rather detects them. When so detected, the system makes the conservative and safe assumption that a broken rail exists beyond the short circuit as described above.

Figure 13:
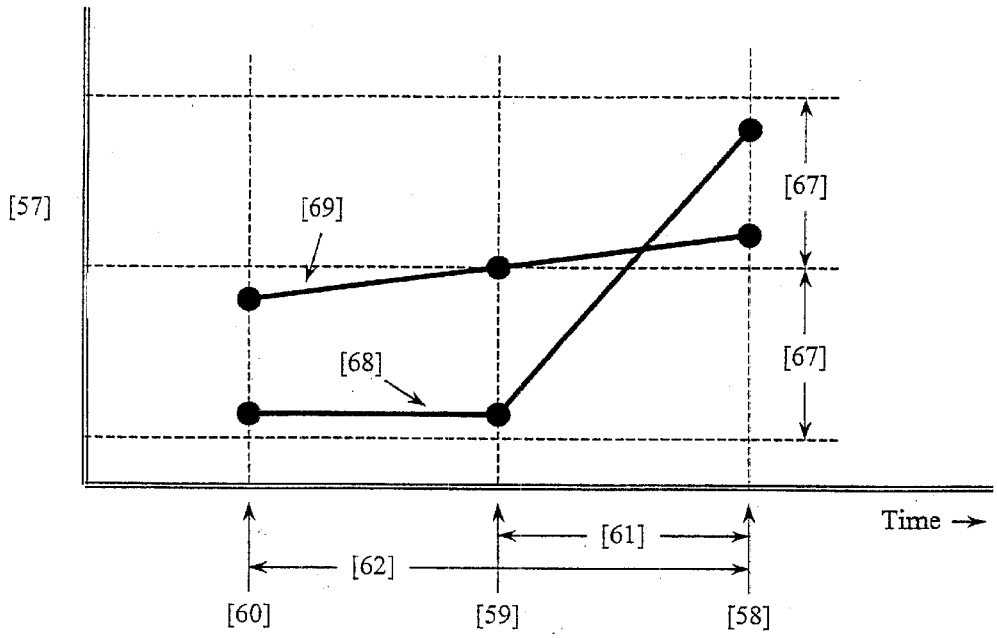
FIG. 13 depicts example sequences of voltage readings made at predefined time intervals for the purpose of illustrating the disclosed method of detection of the presence of foreign metallic objects across the rails.

Referring to FIGS. 5, 12 and 13, the disclosed method involves monitoring of the rate of increase of the OVV's [57] in a similar manner as disclosed above for ballast impedance variation compensation. However, they are monitored at shorter time intervals and to different tolerances because the rate of change of the OVV's [57] due to a short circuit will be much higher.

A "short circuit detection interval tolerance" (SDIT) [72] that functions similarly to the BCIT described above is defined as a user programmable input to the microprocessor-based controller [22]. Because a foreign object will decrease the current loop impedance, this will cause an increase in the OVV's [57]. The SDIT is selected based on the minimum rate at which a foreign object could cause the OVV's [57] to increase, based on the SDI interval. The microprocessor-based controller(s) [22] defines a continuously running series of time intervals called the "short circuit detection interval" (SDI) during each of which, each of the OVV's [57] are sampled and stored. Three such voltages are stored for each OVV: the "short circuit present voltage," (SPV) at time [67]; and the short circuit voltages of the first and second previous intervals, "SP1V" and "SP2V" respectively at times [68] and [69] respectively.

During each SDI, the SPV is subtracted from SP1V and from SP2V, yielding two differential values, "short circuit 1st differential" (S1D) and "short circuit 2nd differential" (S2D) respectively. S1D equals the increase in OVV over the previous interval [70]. S2D equals the increase in the OVV over the previous two intervals [71]. In order to determine the maximum allowable rate of chance of ballast impedance, SDIT [72] is defined as a user programmable input to the microprocessor-based controller [22].

During each SDI, S1D is compared to SDIT [72]. If S1D exceeds SDIT [72], the rate of change indicates a short circuit as shown in the example sequence [73] of OVV [57] readings. Example sequence [74] illustrates a case where the maximum allowable rate has not been exceeded.

Similarly, S2D is compared to SDIT [72] multiplied by two, because the S2D interval [71] is twice as long as the S1D interval [70]. If S2D exceeds SDIT [72] multiplied by two, again the rate of change indicates a short circuit. In order to filter out erroneous voltage readings, which would potentially cause false results in either S1D or S2D, the microprocessor-based controller [22] assumes a broken rail condition only if both the S1D and S2D comparisons indicate a short circuit. It performs this by setting the rail intact (RI(×)) bits disclosed above to the "0" state.

In the event that such a short circuit condition is removed, the microprocessor-based controller [22] provides for an automatic reset of the broken rail condition status. When a short circuit is detected as disclosed above, the OVV [57] levels before the short circuit are stored as the "short circuit reset voltages (SCRV)." OVV's [57] are continually compared with the corresponding SCRV's. If due to the clearing of the physical short circuit on the track, the OVV's reduce back to the SCRV levels within a "short circuit reset tolerance" (SCRT) for two consecutive SDI intervals S1D and S2D, then the broken rail condition status is cleared wherein the calculation of the RI(×) bits is permitted to continue.

As a further refinement of this method, it is to be noted that if the B1D or B2D differentials correspond to a decreasing voltage, this must be caused by an increasing loop impedance. Because a short circuit [56] will increase the loop impedance, it can be safely assumed that the previously mentioned maximum rate of change be exceeded provided that the corresponding OVV's [57] are decreasing. For this reason, the microprocessor-based controller [22] senses whether the OVV's [57] are decreasing and, if so, suspends the determination of a broken rail condition.

I claim:

1. An apparatus for detecting completely broken rails in an unoccupied section of railroad track without insulated joints, the section of track including two rails extending generally parallel to an axis corresponding to train movement and having a physical center, said apparatus comprising:

means for subdividing the track section into current loops, each of the current loops comprising the two rails of the track and two loop terminations, wherein each loop termination is one of a hard-wired shunt and a turnout closure rail, and wherein each of the current loops is formed without any insulated joints separating it from any adjacent portion of the two rails;

means for applying commercial AC power near the physical center, including means for causing, under a condition of the rails being intact, approximately equal currents to flow in each resulting half of the track section;

means for sensing currents through induction of voltages in a coil mounted directly to the rails but electrically isolated from the rails; and means for detecting a rail break through detection of a subsequent decrease in the coil voltage resulting from a reduction of current due to the rail break in at least one half of the track section with respect to a reference value determined while the rails were intact and due to the break, wherein an absence of the detection reflects an intact state of the rails.

2. The apparatus of claim 1, wherein an extremely low impedance of the current loop comprises means for providing immunity from effects of varying ambient track ballast impedances appearing across the rails.

3. The apparatus of claim 1, wherein said means for applying commercial AC power further comprises an adjusting transformer comprising means for adjusting the currents and induced voltages within acceptable levels.

4. The apparatus of claim 1, wherein said means for applying commercial AC power further comprises an enabling relay comprising means for controlling the application of the power.

5. The apparatus of claim 4, wherein said means for break detection comprises at least one microprocessor-based controller, each said controller comprising:

at least one analog input detection point comprising means for monitoring of the induced voltage;

apparatus to connect each detection point to the coil;

a programmed means for performing comparisons and validations necessary to implement the break detection, further comprising means for ensuring fail safety;

means for performing break detection on two or more of the current loops; and means for isolating the break detection from effects of such break detection associated with adjacent and distinct sections of track through control of said enabling relay, wherein a distinct time window, selected from a cyclically recurring set of such time windows, is assigned to each instance of the break detection, such break detection only being performed during the time window.

6. The apparatus of claim 5, wherein the adjacent track sections are controlled by separate and distinct sets of the at least one microprocessor-based controller, and wherein means are provided for the synchronization of the time windows comprising:

a synchronizing clock generating a synchronizing signal, further comprising at least one digital output point comprising means to transmit the signal;

at least one digital input point in each of the microprocessor-based controllers comprising means to receive the signal;

interconnections between the digital output points and digital input points; and a routine programmed in each of the microprocessor-based controllers comprising means of synchronizing the time windows based on the synchronizing signal.

7. The apparatus of claim 1, wherein the track-mounted coil comprises means to isolate the induced voltages from effects of ambient DC currents and voltages that may be present in the track section.

8. The apparatus of claim 2, wherein the coil is arranged in a "figure eight" configuration comprising means for eliminating effects of ambient AC interfering currents and induced voltages through a vector cancellation effect.

9. The apparatus of claim 1, further comprising twisted pair, shielded wires connecting the coil to the detection points and comprising means to eliminate the effects of interfering currents and resulting induced voltages.

10. The apparatus of claim 1, wherein said means for break detection comprises at least one microprocessor-based controller, each said controller comprising:

at least one analog input detection point comprising means for monitoring of the induced voltage;

apparatus to connect each detection point to the coil; and a programmed means for performing comparisons and validations necessary to implement the break detection, further comprising means for ensuring fail safety.

11. The apparatus of claim 10, wherein each said controller further comprises means for performing break detection on two or more of the current loops.

12. The apparatus of claim 10, wherein an amplifier is associated with each detection point, said amplifier comprising means for amplifying and/or rectifying the voltage induced in the coil to a level consistent with an operating range of the analog input points.

13. The apparatus of claim 10, wherein each said controller comprises at least two detection points.

14. The apparatus of claim 13, wherein said detecting means includes means for providing two independent and functionally identical instances of the break detection using the two detection points.

15. The apparatus of claim 14, wherein each said controller comprises means for enhancing fail-safety through verification of the absence of break detection in both of the instances thereof as a condition for the determination that the rails are intact.

16. The apparatus of claim 13, wherein each said controller comprises at least three detection points.

17. The apparatus of claim 16, wherein said detecting means includes means for providing two independent and functionally identical instances of the break detection using two of the detection points, and wherein means to enhance availability is provided such that in the event of failure of one or more detection points, the twofold independent and functionally identical break detections are performed utilizing two of the remaining unaffected detection points.

18. The apparatus of claim 10, wherein each said controller comprises at least one analog input source point further comprising means for the detection of variations in the voltage of the commercial AC power source.

19. The apparatus of claim 18, wherein each said controller, using the at least one source point, comprises means for enhancing fail-safety by providing compensation for voltage variations through continuous adjustment of reference values used in the break detection.

20. The apparatus of claim 19, further comprising means for providing two independent and functionally identical instances of the voltage variation compensation using the two source points.

21. The apparatus of claim 20, wherein each said controller comprises means to enhance fail-safety through application of voltage variation compensation in both of the instances thereof as a condition for the determination that the rails are intact.

22. The apparatus of claim 18, wherein each said controller comprises at least two source points.

23. The apparatus of claim 2, wherein each said controller comprises at least three source points.

24. The apparatus of claim 23, further comprising means for providing two independent and functionally identical instances of the voltage variation compensation using two of the source points, said apparatus further comprising means for enhancing system availability such that in the event of failure of one or more source points, the twofold independent and functionally identical voltage variation compensation may be performed utilizing two of the remaining unaffected source points.

25. The apparatus of claim 10, wherein at least two microprocessor-based controllers are provided each comprising means to enhance fail-safety through the twofold independent and functionally identical executions.

26. The apparatus of claim 25, wherein at least three microprocessor-based controllers are provided each comprising means to enhance availability such that in the event of failure of one or more of the microprocessor-based controllers, the twofold independent and functionally identical executions may be performed utilizing two of the remaining unaffected microprocessor-based controllers.

27. The apparatus of claim 10, further comprising means for enhancing fail-safety by providing compensation for variations in ballast impedance through continuous adjustment of reference values used in the break detection, provided that the rate of such variations is within predetermined tolerances associated with varying ambient conditions as opposed to breaks in the rails.

28. The apparatus of claim 27, further comprising means for enhancing reliability by eliminating effects of erroneous voltage readings associated with the compensation for variations in ballast impedance.

29. The apparatus of claim 27, further comprising means for enhancing fail-safety by providing detection of foreign metallic objects across the rails through continuous monitoring of a rate of change of reference values used in the break detection, wherein a broken rail condition is assumed if such rate is within a predetermined range associated with a presence of such an object as opposed to those associated with the compensation for variations in ballast impedance.

30. The apparatus of claim 29, further comprising means for enhancing reliability by eliminating effects of erroneous voltage readings associated with the detection of a foreign object across the rails.

31. The apparatus of claim 29, further comprising means for automatically resetting the assumption of broken rail status if and when all detected foreign metallic objects are removed.

32. A method for detecting completely broken rails in an unoccupied section of railroad track without insulated joints, the section of track including two rails extending generally parallel to an axis corresponding to train movement and having a physical center, said method comprising the steps of:

subdividing the track section into current loops, each of the current loops comprising the two rails of the track and two loop terminations, wherein each loop termination is one of a hard-wired shunt and a turnout closure rail, wherein and each of the current loops is formed without any insulated joints separating it from any adjacent portion of the two rails;

applying commercial AC power near the physical center, including the step of causing, under a condition of the rails being intact, approximately equal currents to flow in each resulting half of the track section;

sensing currents through induction of voltages in a coil mounted directly to the rails but electrically isolated from the rails; and detecting a rail break through detection of a subsequent decrease in the coil voltage resulting from a reduction of current due to the rail break in at least one half of the track section with respect to a reference value determined while the rails were intact and due to the break, wherein an absence of the detection reflects an intact state of the rails.

* * * * *